US010254076B2

(12) United States Patent
Penrod

(10) Patent No.: US 10,254,076 B2
(45) Date of Patent: Apr. 9, 2019

(54) APPARATUS FOR USE WITH A DISRUPTER TO DISABLE EXPLOSIVE ORDNANCE AND IMPROVISED EXPLOSIVE DEVICES

(71) Applicant: John Francis Penrod, Wilmington, DE (US)

(72) Inventor: John Francis Penrod, Wilmington, DE (US)

( * ) Notice: Subject to any disclaimer, the term of this patent is extended or adjusted under 35 U.S.C. 154(b) by 122 days.

(21) Appl. No.: 15/217,428

(22) Filed: Jul. 22, 2016

(65) Prior Publication Data

US 2017/0138713 A1 May 18, 2017

Related U.S. Application Data

(63) Continuation of application No. 62/199,858, filed on Jul. 31, 2015.

(51) Int. Cl.
*F42B 33/06* (2006.01)
*F41H 11/12* (2011.01)
(Continued)

(52) U.S. Cl.
CPC ..... *F41B 9/0046* (2013.01); *F41A 23/02* (2013.01)

(58) Field of Classification Search
CPC .. F42B 33/06; F42B 10/14; F42D 5/04; F42A 21/32; F42A 21/325; F41C 27/04;
(Continued)

(56) References Cited

U.S. PATENT DOCUMENTS 2,747,856 A * 5/1956 Burdwood ..... B23K 7/001 266/66
2,805,602 A * 9/1957 Moore ..... F41A 21/26 89/14.5
(Continued)

FOREIGN PATENT DOCUMENTS

CN 202045633 U 11/2011
CN 203584993 U 5/2014
(Continued)

OTHER PUBLICATIONS

Russell, "Recent Advances on the Design of Lightweight Dismounted Disruptors", http://www.ingentaconnect.com/content/ben/meng/2014/00000007/00000001/art00006, (2014).

*Primary Examiner* — Derrick R Morgan
(74) *Attorney, Agent, or Firm* — O'Rourke Law Office, LLC

(57) ABSTRACT

An apparatus for use with a disrupter to disable explosive ordnance and improvised explosive devices is described. In a preferred embodiment, the apparatus comprises a sleeve adapted to be fit around the barrel of the disrupter, wherein the sleeve has an opening of generally circular cross section and an aperture for holding a positioning rod; and a positioning rod connected to the sleeve through the aperture for positioning the disrupter in relation to the explosive ordnance or improvised explosive device. The use of the sleeve and positioning rod combination permits rapid determination of stand-off for the disrupter and the angle of impact of the charge the disrupter will fire. The device is particularly useful in disabling pipe bombs.

10 Claims, 13 Drawing Sheets

(51) Int. Cl.
*F41B 9/00* (2006.01)
*F41A 23/02* (2006.01)

(58) Field of Classification Search
CPC ..... F41C 27/16; F41C 27/06; F41C 27/20; F41C 27/22; F41H 11/16; F41H 11/12; F41H 11/138; F41H 11/161; F41H 11/162
See application file for complete search history.

(56) References Cited

U.S. PATENT DOCUMENTS 3,117,518 A * 1/1964 Porter ..... F42B 3/08 102/307
3,216,320 A * 11/1965 Thomas ..... E21B 7/007 102/259
3,242,862 A * 3/1966 Stegbeck ..... B63G 7/00 102/403
3,724,372 A * 4/1973 Phillips ..... F42B 33/06 102/306
3,913,252 A * 10/1975 Musgrave ..... F41C 27/04 42/90
3,950,877 A * 4/1976 Musgrave ..... F41C 27/20 42/90
3,950,878 A * 4/1976 Musgrave ..... F41A 21/30 42/90
4,115,944 A * 9/1978 Musgrave ..... F41C 27/20 42/90
4,342,425 A * 8/1982 Vickers ..... B05B 1/34 134/34
4,393,614 A * 7/1983 Pickett ..... F41A 23/06 42/94
4,431,350 A * 2/1984 Abrahamson ..... B23Q 5/326 408/10
4,481,713 A * 11/1984 Howell ..... B43K 17/04 33/32.3
H000162 H * 11/1986 Sullivan, Jr. ..... 102/363
4,688,770 A * 8/1987 Keedy ..... B23K 7/102 266/66
4,930,872 A * 6/1990 Convery ..... A61B 5/0059 250/397
5,210,368 A 5/1993 Heller, Jr. et al.
5,361,676 A * 11/1994 Gibbs ..... B64G 1/641 102/378
5,386,758 A * 2/1995 Conley ..... F42B 33/06 86/50
5,936,184 A * 8/1999 Majerus ..... F42B 3/08 102/306
6,453,788 B1 * 9/2002 Lebet ..... F42B 1/02 102/306
6,484,617 B1 * 11/2002 Anderson ..... F41H 11/12 102/293
6,490,957 B1 * 12/2002 Alexander ..... F41B 11/00 102/230
6,546,838 B2 * 4/2003 Zavitsanos ..... C06B 33/00 102/364
6,606,950 B1 * 8/2003 Putman ..... F41H 11/12 102/306
6,644,166 B2 11/2003 Alexander et al.
D511,366 S 11/2005 Brown
7,047,862 B1 5/2006 Davis et al.
7,134,375 B2 11/2006 Fish, Jr.
7,328,751 B2 * 2/2008 Peterson ..... B25B 27/0085 173/1
7,533,597 B1 * 5/2009 Strohman ..... F16C 11/10 403/150
8,245,430 B1 8/2012 Owenby et al.
8,413,570 B2 4/2013 Langner
8,959,821 B1 * 2/2015 Calvert ..... F41A 21/18 42/76.01
9,055,886 B1 * 6/2015 Garretson ..... G01N 23/203
9,157,705 B1 * 10/2015 Majerus ..... F41H 11/12
9,797,693 B1 * 10/2017 Patel ..... F41H 11/12
9,857,157 B2 * 1/2018 Scheid ..... F42B 1/02
2004/0251647 A1 12/2004 Graham
2005/0081706 A1 * 4/2005 Alford ..... F42B 33/062 89/1.13
2008/0011152 A1 * 1/2008 Weiss ..... F41A 19/58 86/50
2008/0121097 A1 * 5/2008 Rudakevych ..... F41A 19/58 89/28.05
2012/0192704 A1 * 8/2012 Wilson ..... F42B 12/46 86/50
2013/0055880 A1 * 3/2013 Dennis ..... F41H 11/28 89/1.13
2013/0160342 A1 * 6/2013 Melton ..... F41C 27/00 42/90
2014/0245880 A1 9/2014 Rabec Le Gloahec

FOREIGN PATENT DOCUMENTS

EP 0178039 A2 4/1986
GB 2230846 A 10/1990

* cited by examiner

APPARATUS FOR USE WITH A DISRUPTER TO DISABLE EXPLOSIVE ORDNANCE AND IMPROVISED EXPLOSIVE DEVICES

CROSS-REFERENCE TO RELATED APPLICATIONS

This application claims priority to provisional application Ser. No. 62/199,858 filed Jul. 31, 2015, the disclosure of which is incorporated by reference as if fully set forth herein.

TECHNICAL FIELD

The embodiments described herein relate to an apparatus for use in connection with explosive ordnance disposal (EOD) or improvised explosive device (IED) disrupters to disable ordnance or improvised explosive devices and methods for using the same.

BACKGROUND

Disrupters are used by various military, police, and other emergency personnel to destroy or disable various improvised explosive devices or ordnance. A disrupter is typically designed using a barrel similar to a shotgun barrel. A 12 gauge barrel is especially common, although other calibers are used. A disrupter comprises a barrel section having a muzzle end, a bore, and a chamber (breach end).

Disrupters are used to interrupt the firing chain of an improvised explosive device or other ordnance to prevent an explosion from occurring and thereby damaging nearby property. Disrupters can be electric or non-electric. An especially common disrupter is a percussion actuated non-electric disrupter (i.e., a PAN disrupter). Disrupters can be used in conjunction with adjustable stands or as stand-alone instruments (i.e., without a stand).

Disabling an IED presents special challenges to police and military personnel. IEDs are frequently placed in hidden locations. That is, they are hidden within other objects (e.g., luggage) or surreptitiously placed among other objects.

IEDs can also be detonated in a variety of ways. For example, an IED can be detonated using a fuse, a timer, or by radio-control. As a result, disabling these devices quickly and efficiently is of particular importance.

Although robots are sometimes used to position disrupters adjacent to an IED, the use of robots suffers from various drawbacks. For example, a robot may not be able to reach an area where an IED has been placed. As a result, it is frequently necessary for the disrupter to be placed against an IED by a human operator.

When a human operator positions a disrupter near an IED, a critical consideration that must be addressed is the "time on target". The time on target is the amount of time the operator must spend in proximity to the device to position the disrupter so that the IED may be disabled. It is highly desirable for the time on target to be as short as possible to minimize risk to the human operator.

When a human operator positions a disrupter against an IED, multiple considerations must be addressed. Two especially important considerations are the stand-off for the disrupter and the angle of impact of the disrupter charge against the target. Stand-off refers to the distance from the end of the disrupter barrel to the point of impact on the IED. The angle of impact refers to the angle at which the disrupter charge will impact the IED.

IEDs can take a variety of forms. One of the most common forms is the pipe bomb. A pipe bomb is essentially an explosive device made of a piece of standard piping with a cap at each end. The bomb can be detonated by various means known in the art including fuse, timer, or radio control.

The embodiments described herein are capable of disabling a wide variety of explosive ordnance and IEDs. They are especially useful in disabling pipe bombs.

BACKGROUND OF THE RELATED ART

Various devices for holding a disrupter have been taught in the art. These include:

U.S. Pat. No. 8,413,570 teaches a disrupter ejection and recovery system. The system includes a barrel mounting device that may be secured to the barrel section of a disrupter as part of the ejection and recovery system.

UK Patent Application 2,230,846 describes a tether loop and anti-roll sleeve used to hold a disrupter.

U.S. Pat. No. 8,245,430 describes tubular members that can be attached to the breach of a disrupter to hold a disrupter in place.

U.S. Pat. No. 4,210,368 teaches a bomb neutralizing apparatus that has a mounting block for holding a disruptor in the described assembly.

U.S. Pat. No. 7,533,597 describes an adapter mechanism for explosive ordnance disrupter apparatus. The mechanism contains a yoke with apertures for mounting a primary and secondary disrupter.

European Patent Application 0 178 039 describes a disrupter for explosive devices which comprises a holding member for holding two disrupters.

Published U.S. Application 2004/0251647 teaches an emergency response handcart. In one embodiment, the handcart contains a rotating mounting bar for holding a disrupter on its terminal end.

In addition to the devices designed to hold a disrupter described above, several methods of positioning a disrupter are known in the art. For example, U.S. Pat. No. 7,134,375 teaches a visual assistance guide system for disrupter placement and a method of using same. The system employs a checkerboard base and adhesive containing areas on the base to help position a disrupter. However, the system described therein is preferably positioned using a robot.

United States Published Application 2014/0245880 A1 describes a method and set for positioning and aligning a disrupter for the deactivation of a target. The method described in this reference employs a laser. It has been found that use of a laser is problematic when using a human operator to position a disrupter. Specifically, a human operator typically must remove the laser before disabling the ordnance or IED. This is done in order to avoid destruction of the laser in the event the IED detonates. This has the effect of possibly moving the disruptor off target. In addition, the time on target for the human operator is greatly increased.

U.S. Pat. No. 7,047,862 discloses a MK38 Small Caliber Dearmer Aiming Device. This patent teaches use of two V-shaped attachments at the end of a disrupter. The V-shaped attachments are fitted over a target and the disrupter is pushed towards the target to ensure a minimum set-off distance.

This device has a number of drawbacks. These include the fact that the device will only work on a specifically shaped target—i.e., one that can fit between the two v-shaped protrusions. In addition, the target must be accessible to the V-shaped protrusions. This device is not satisfactory when used with IED's in hard to reach locations. In addition, pushing this device forward over an IED risks accidental detonation of the device to the hazard of a human operator.

The embodiments described herein are different from and advantageous over the foregoing devices and methods. Among the differences between the described embodiments and the foregoing devices is the use of a positioning rod to position a disrupter at a proper stand-off.

BRIEF DESCRIPTION OF THE ILLUSTRATIONS

SUMMARY OF THE EMBODIMENTS DESCRIBED HEREIN

Figure 1:
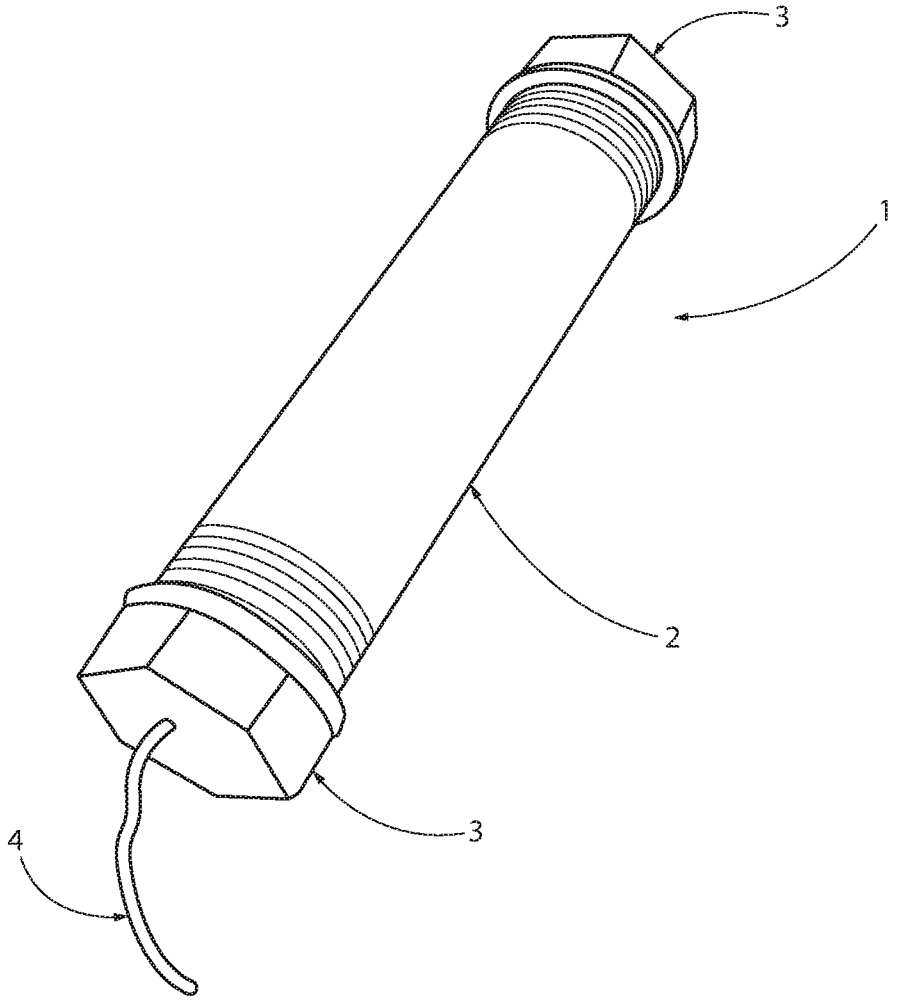
FIG. 1 is a perspective illustration of a typical fuse-detonated pipe bomb.

It has been surprisingly found that disabling IEDs and explosive ordnance is greatly facilitated by the embodiments described herein.

In one aspect, the embodiments shown relate to an apparatus for use in connection with a disrupter having a barrel for disabling an explosive ordnance or improvised explosive device, the apparatus comprising: a sleeve adapted to be fit around the barrel of the disrupter, wherein the sleeve has an opening of generally circular cross section and an aperture for holding a positioning rod; and a positioning rod connected to the sleeve through the aperture for positioning the disrupter in relation to the explosive ordnance or improvised explosive device. In a preferred embodiment, the opening and the aperture are connected. In another preferred embodiment, the opening and aperture are separate.

In another aspect, the positioning rod contains incremental measurements of distance. In a preferred embodiment, the incremental measurements of distance are in inches. However, metric units of measurement may also be used. In fact, any appropriate increment markings can be used.

In another aspect, the sleeve is in the shape of a rectangular cube. In another aspect, the sleeve is in the shape of a square cube. In another embodiment, at least one outer surface of the sleeve is flat.

In another aspect, the sleeve and positioning rod are made of non-spark producing metal. In another preferred embodiment, the sleeve and positioning rod are made of plastic.

In another aspect, the embodiments described herein relate to a method of disabling an explosive ordnance using a disrupter and a positioning apparatus, the method comprising placing the positioning apparatus over a barrel of the disrupter wherein the positioning apparatus comprises: a sleeve adapted to be fit around the barrel of the disrupter, wherein the sleeve has an opening of generally circular cross section and an aperture for holding a positioning rod; and a positioning rod connected to the sleeve through the aperture for positioning the disrupter in relation to an explosive ordnance; positioning the disrupter in relation to the explosive ordnance using the positioning rod to determine the distance between the disrupter and the ordnance; and disabling the ordnance by firing the disrupter. In another preferred embodiment, the explosive ordnance is an improvised explosive device. In an especially preferred embodiment, the improvised explosive device is a pipe bomb.

In a preferred embodiment, the ordnance is a pipe bomb comprising a piece of pipe with two ends and wherein each end has an end cap attached to the pipe. In a further preferred embodiment, the disrupter is positioned so that it fires a projectile against the lip of an end cap. In still another preferred embodiment, the disrupter is positioned so that it fires a projectile against the body of the pipe.

In another aspect, the embodiments shown relate to an apparatus for use in connection with a disrupter having a barrel for disabling an explosive ordnance or improvised explosive device, the apparatus comprising: a sleeve adapted to be fit around the barrel of the disrupter, wherein the sleeve has an opening of generally circular cross section and an aperture for holding a positioning rod wherein the aperture is separate from the opening by a distance sufficient to accommodate use of a projectile in the disrupter that has an end portion that exceeds the barrel size of the disrupter; and a positioning rod connected to the sleeve through the aperture for positioning the disrupter in relation to the explosive ordnance or improvised explosive device. In a preferred embodiment using this structure, the positioning rod is contacting against the end portion of the projectile and can be used to position the disrupter against the ordnance.

The embodiments described herein can be used with a disrupter and a stand for holding the disrupter. In another preferred embodiment, the disrupter/sleeve/positioning rod combination described herein is used without a stand. It has been surprisingly found that use of a flat outer surface on one side of the sleeve prevents the disrupter from rolling. In addition, use of the combination levels the disrupter. These benefits are especially advantageous where a stand cannot be used due to the location of an IED.

DETAILED DESCRIPTION OF THE EMBODIMENTS DESCRIBED HEREIN

As required, detailed illustrative embodiments are disclosed herein. However, it is to be understood that the disclosed embodiments are merely exemplary of the invention that may be embodied in various and alternative forms.

The drawings are not necessarily to scale and some details may be exaggerated or minimized to show details of particular components. Therefore, the specific structural and functional details described herein are not to be interpreted as limiting, but merely as a representative basis for teaching one skilled in the art to variously employ the illustrative embodiments disclosed herein.

With reference to FIG. 1, a typical metal pipe bomb (1) is shown. Pipe bomb (1) contains a piece of standard piping for the body (2) and two metal end caps (3). In the embodiment shown, pipe bomb (1) is detonated via fuse (4). Other methods of detonating explosives, however, are well-known in the art.

Figure 2:
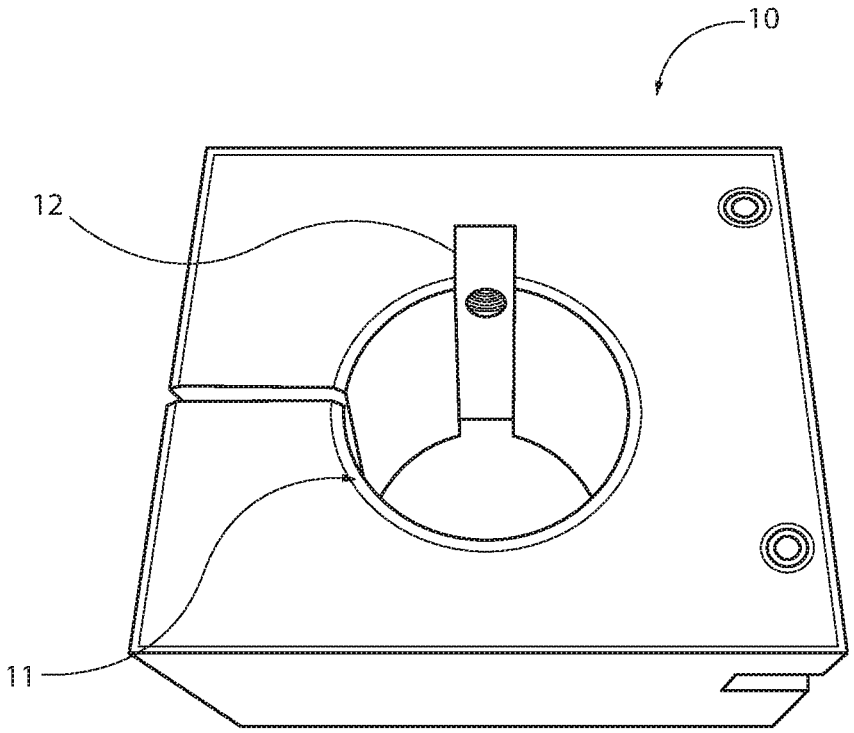
FIG. 2 is a bottom front perspective view of an embodiment described herein of a sleeve adapted to be fit around the barrel of a disrupter.

With reference to FIG. 2, a sleeve (10) adapted to be fit around the barrel of a disrupter is shown. Sleeve (10) has opening (11) which is of generally circular cross section and adapted to fit around the barrel of a disrupter. Sleeve also has aperture (12) which is adapted to hold a positioning rod (not shown). In the embodiment shown, opening (11) and aperture (12) are connected (i.e., they are contiguous). It should be noted, however, that opening (11) and aperture (12) could be non-contiguous.

Sleeve (10) can be made of any suitable metal. However, a non-spark producing metal is preferred. Aluminum is most especially preferred. However, other non-spark producing materials such as plastic, wood, or fiberglass could be used.

In the embodiment shown, sleeve (10) is in the shape of a rectangular cube. However, other shapes such as a square cube or a triangular polyhedron can be used. In a preferred embodiment, at least one outer surface is flat. Use of a sleeve with one flat outer surface prevents the disrupter from rolling when it is used without a stand. This is especially advantageous when an IED is located in an area that does not permit use of stand.

Figure 3:
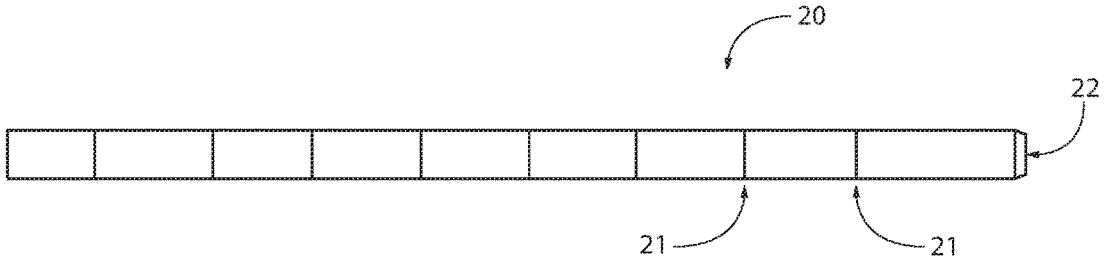
FIG. 3 is a top view of a positioning rod used in the embodiments described herein.

With reference to FIG. 3, positioning rod (20) is shown. Positioning rod (20) has incremental measurements of distance (21), along at least one side. In the embodiment shown, these increments are in inches. However, any suitable measurement of distance could be used. Also preferred are metric units of measurement.

Positioning rod (20) is shaped in a rectangular cube. End (22) is most preferably square. The positioning rod can be made of any suitable metal. However, non-spark producing metal is preferred. Aluminum is most especially preferred. However, non-spark producing materials such as plastics or wood could be used.

Positioning rod (20) can be in a variety of shapes. A rectangular cube shape is preferred. However, positioning rod (20) could be cylindrical. Positioning rod (20) could also be a triangular polyhedron.

Figure 4:
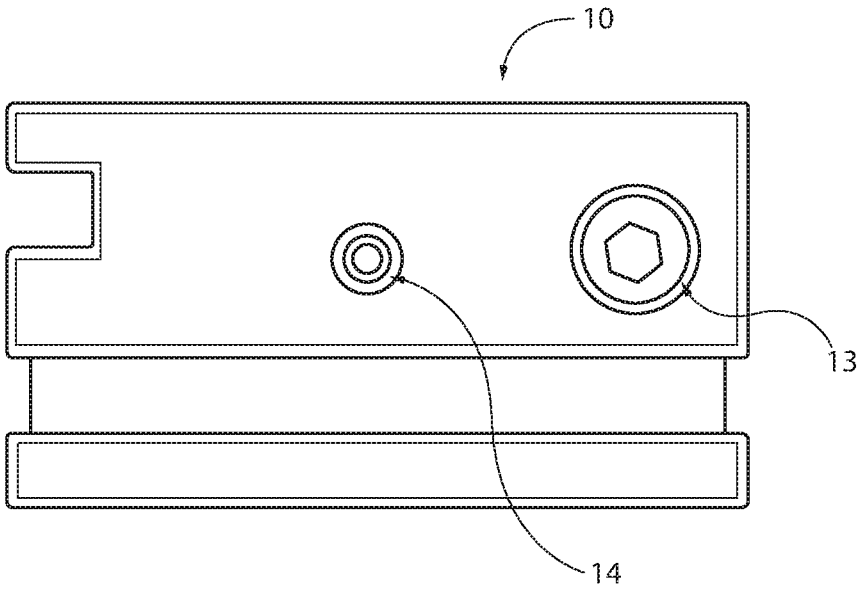
FIG. 4 is a top view of an embodiment described herein of a sleeve adapted to be fit around the barrel of a disrupter.

With reference to FIG. 4, a top view of sleeve (10) is shown. The sleeve and rod can be adjusted via tightening devices. A preferred embodiment is an Allen screw. These are shown in FIG. 4 as items (13) and (14). Screw (13) is used to adjust the tightness of the sleeve (10) around the barrel of a disrupter. Screw (14) is used to adjust the tightness of the sleeve (10) around a positioning rod. By tightening the screws, the sleeve and the positioning rod are held in place. By loosening the screws, the sleeve and the positioning rod can be moved relative to the disrupter and each other. For example, the positioning rod (not shown) can be adjusted to various increments of distance.

Figure 5:
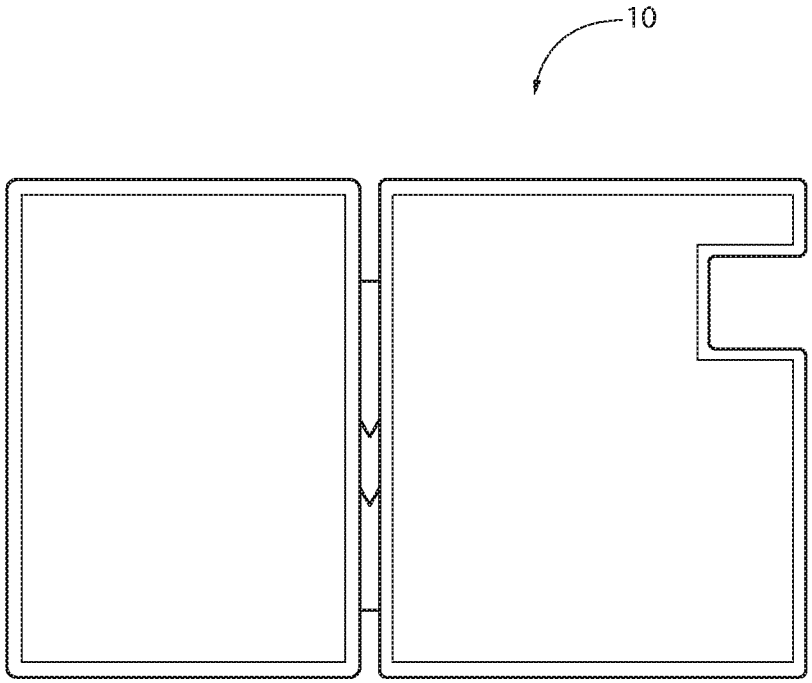
FIG. 5 is a side view of an embodiment described herein of a sleeve adapted to be fit around the barrel of a disrupter.
Figure 6:
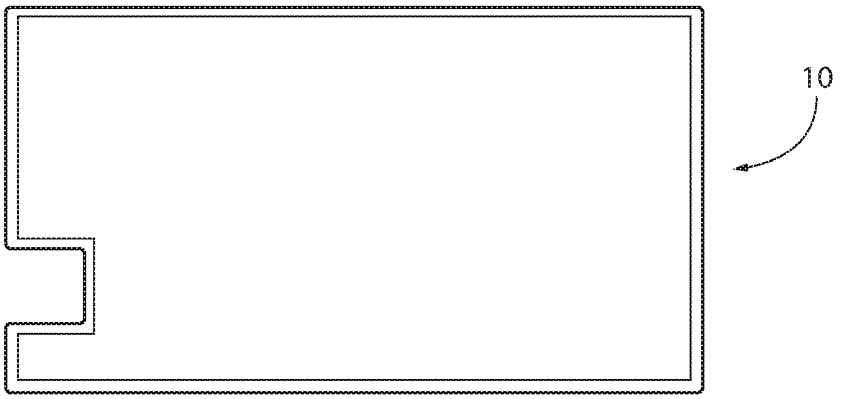
FIG. 6 is a bottom view of an embodiment described herein of a sleeve adapted to be fit around the barrel of a disrupter.

With reference to FIG. 5, a side view of sleeve (10) is shown. With reference to FIG. 6, a bottom view of sleeve (10) is shown.

Figure 7:
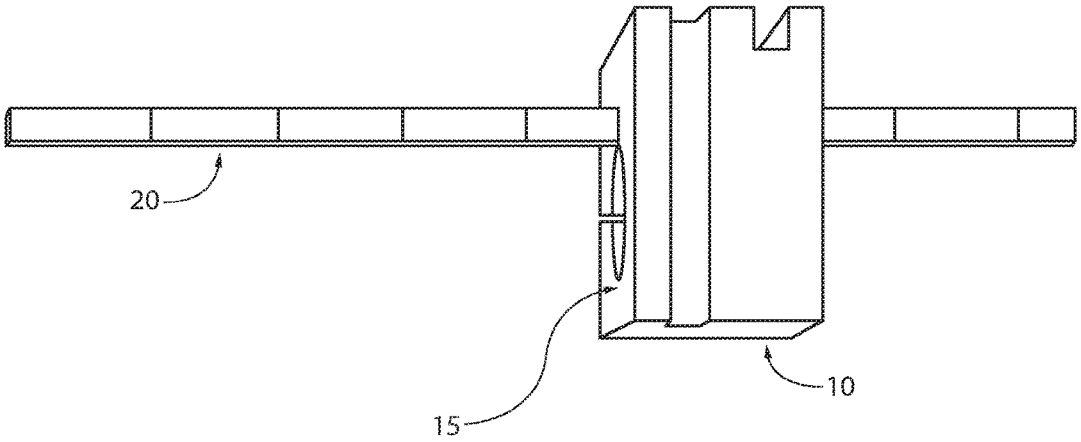
FIG. 7 is a side perspective view of an embodiment described herein of a sleeve adapted to be fit around the barrel of a disrupter and a positioning rod.
Figure 8:
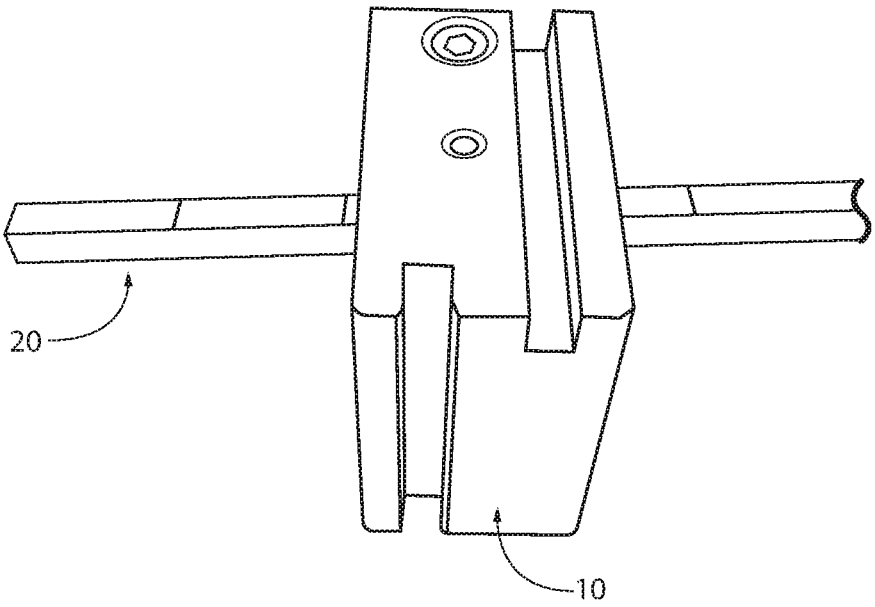
FIG. 8 is an additional perspective view of an embodiment described herein of a sleeve adapted to be fit around the barrel of a disrupter and a positioning rod.

With reference to FIG. 7, a side perspective view of the combination of a sleeve (10) and positioning rod (20) is shown. The positioning rod (20) protrudes from the front surface (15) of sleeve (10). In the embodiment shown, the positioning rod protrudes approximately 5 inches from the front of the sleeve. FIG. 8 shows an additional perspective view of the combination of a sleeve (10) and a positioning rod (20).

Figure 9:
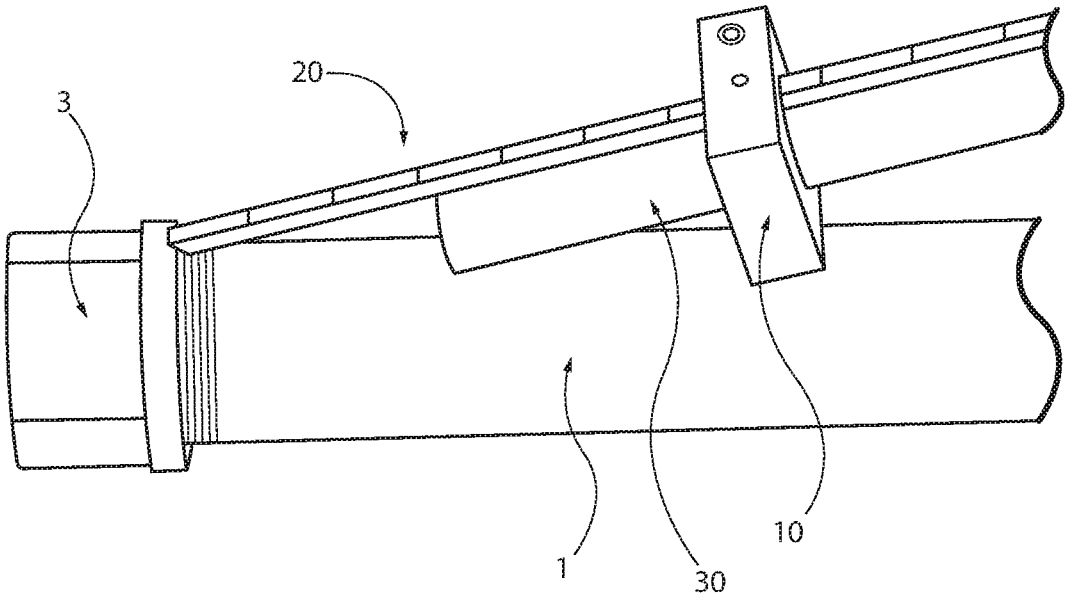
FIG. 9 is an in-use view of the embodiment shown in FIG. 7 of a sleeve adapted to be fit around the barrel of a disrupter and a positioning rod placed around the barrel of a disrupter and positioned against the lip of an end cap of a pipe bomb.

With reference to FIG. 9, the use of the combination of a sleeve (10) and a positioning rod (20) is shown in use in connection with the barrel of a disrupter (30). A human operator (not shown) is positioning a disrupter against a standard metal pipe bomb (1). Disrupter (30) will fire a charge against a lip of end cap (3). In the most preferred embodiment, the flat surface of the end of positioning rod (20) nearest the muzzle of disruptor (30) rests against the top edge of the lip of end cap (3). This ensures a proper stand-off distance and the angle of impact for the disrupter charge.

It should be understood that there are two known means for rendering metal pipe bombs safe. These methods are the direct impact method and the skip method. In the direct impact method, a disrupter fires a charge against the lip of an end cap of a pipe bomb. This charge is designed to dislodge the end cap from the body of the pipe bomb and thereby prevent detonation of the pipe bomb. In a preferred embodiment, the use of the positioning rod and sleeve combination gives proper stand-off and angle of impact between the end of the barrel and the end cap of the pipe bomb.

With reference to FIG. 9, the rod (20) shown has a square cross section. When an operator aligns the bottom lip of positioning rod (20) against the top edge of the end cap (3) of a pipe bomb (1), this results in the proper angle of impact in the direct method. The proper stand-off is achieved via the incremental distance markers.

In the skip method, the disrupter fires a projectile against a surface on the body of the pipe portion of the pipe bomb. This projectile deforms the body of the pipe bomb and skips along the body of the pipe portion and impacts an end cap with enough force to dislodge the end cap. The sleeve and positioning rod combination can be used with this method as well.

A pipe bomb may also be made out of PVC piping. When disabling a pipe bomb of this type, a disrupter typically fires a water charge at an angle of impact perpendicular to the surface of the PVC pipe body. The embodiments described herein are useful in disabling PVC pipe bombs and facilitate determining the proper stand-off distance, the point of impact, and the angle of impact.

Figure 10:
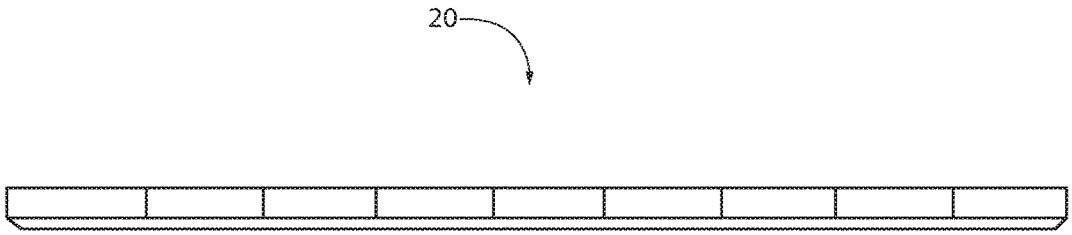
FIG. 10 is an additional top view of a positioning rod used in the embodiments described herein with distance increments marked along the length of the rod.

With reference to FIG. 10, an additional view of a positioning rod is shown.

Figure 11:
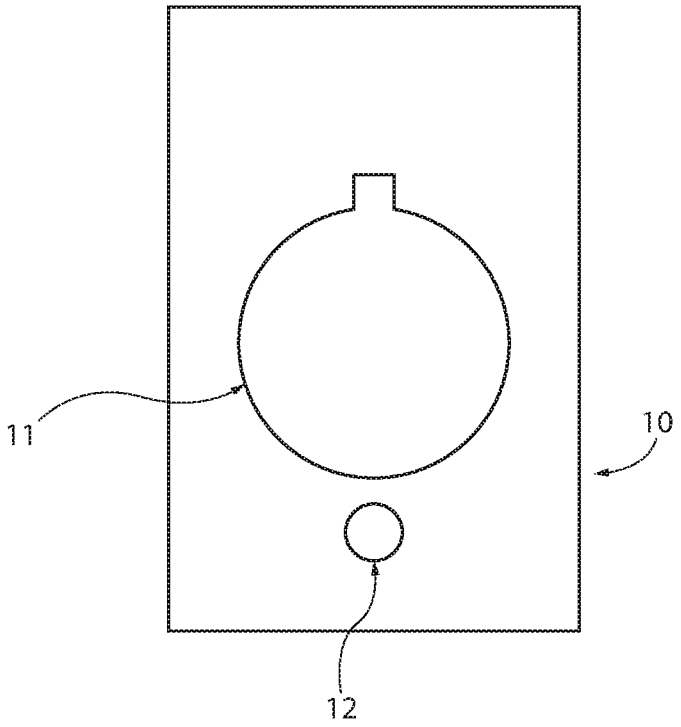
FIG. 11 is a front view of an alternative embodiment described herein of a sleeve adapted to be fit around the barrel of a disrupter.

With reference to FIG. 11, an alternative embodiment of positioning sleeve (10) is shown. In this embodiment, positioning sleeve has opening (11) which is of generally circular cross section and adapted to fit around the barrel of a disrupter. Sleeve also has aperture (12) which is adapted to hold a positioning rod (not shown). In the embodiment shown, opening (11) and aperture (12) are not contiguous. In addition, aperture (12) is separate from the opening (11) by a distance sufficient to accommodate use of a projectile in the disrupter that has an end portion that exceeds the barrel size of the disrupter.

Figure 12:
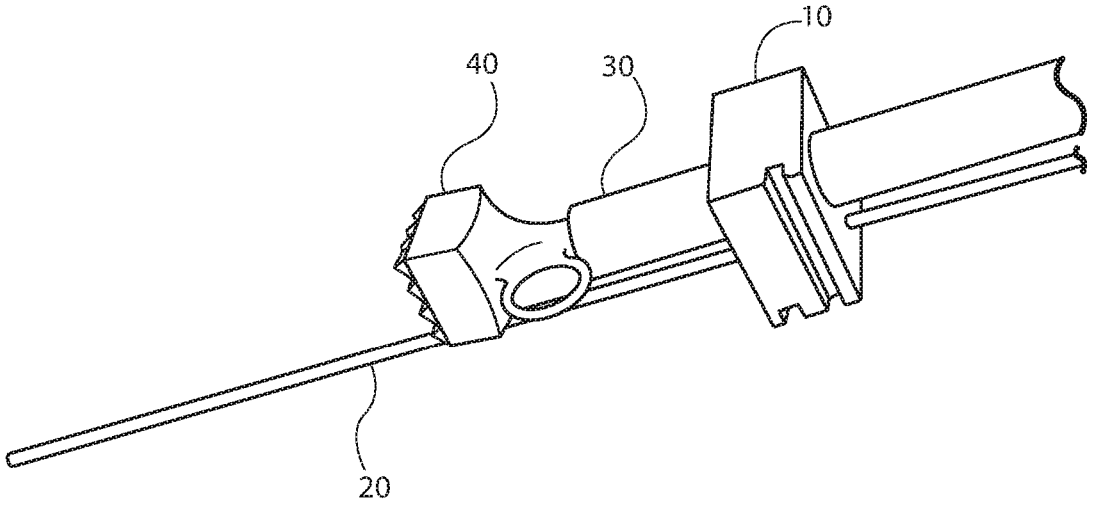
FIG. 12 is a perspective view of an alternative embodiment using the sleeve shown in FIG. 11.
Figure 13:
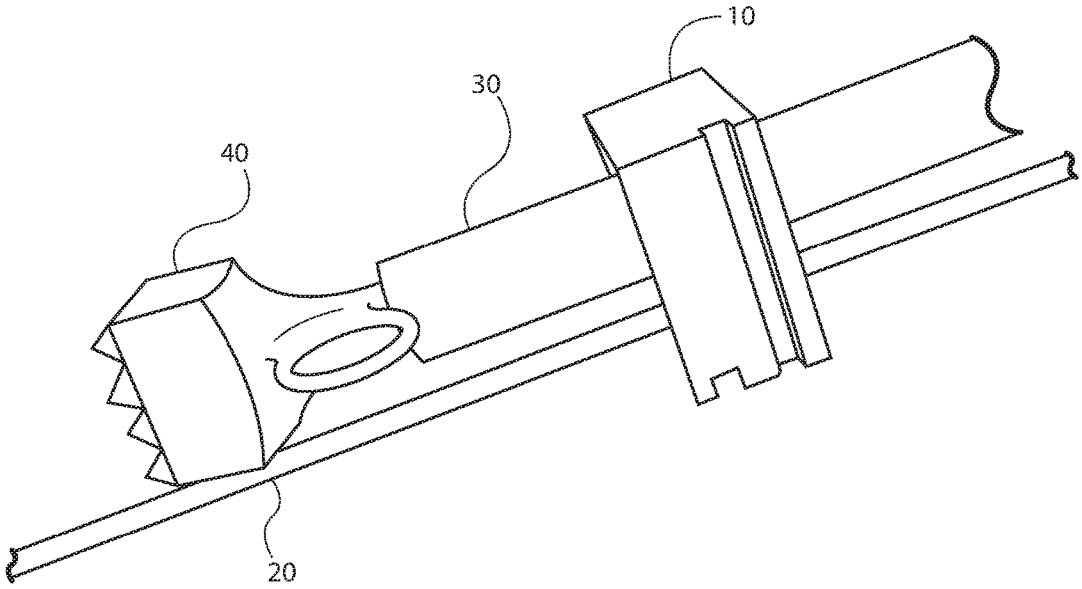
FIG. 13 is another perspective view of an alternative embodiment using the sleeve shown in FIG. 11.

Such a structure is shown in FIG. 12 and FIG. 13. In FIG. 12, chisel (40) is loaded into barrel of disrupter (30); and a positioning rod (20) connected to the sleeve through the aperture for positioning the disrupter in relation to the explosive ordnance or improvised explosive device. In a preferred embodiment using this structure, the positioning rod (20) is contacting against the end portion of the chisel (40) and can be used to position the disrupter (30) against the ordnance.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of disabling an explosive ordnance using a disrupter and a removable positioning apparatus, the method comprising placing the positioning apparatus over a barrel of the disrupter wherein the disrupter is a barrel-type propellant driven projectile firing disrupter and wherein the positioning apparatus comprises:

a block shaped with at least one flat side containing a sleeve adapted to be fit around the barrel of the disrupter wherein the block is configured to rest on a surface and the block is sized so that the at least one side of the block prevents the disrupter from rolling when that side is in contact with a surface, wherein the sleeve has an opening of generally circular cross section and an aperture for holding a positioning rod parallel to the disrupter barrel; and an adjustable positioning rod connected to the sleeve through the aperture for positioning the disrupter in relation to an explosive ordnance; positioning the disrupter in relation to the explosive ordnance by adjusting the positioning rod to determine the standoff distance between the disrupter and the ordnance; and adjusting the position of the disrupter to determine the angle of impact of the projectile; and disabling the ordnance by firing the disrupter.

2. The method of claim 1, wherein the explosive ordnance is an improvised explosive device.

3. The method of claim 1, wherein the explosive ordnance is a pipe bomb comprising a piece of pipe with two ends and wherein each end has an end cap attached to the pipe.

4. The method of claim 3, wherein at least one end cap has at least one lip and wherein the disrupter is positioned so that it fires a projectile against the lip of an end cap.

5. The method of claim 3, wherein the disrupter is positioned so that it fires a projectile against the body of the pipe.

6. The method of claim 1, wherein the positioning apparatus contains a screw adapted to tighten the apparatus around the barrel of the disrupter and a screw adapted to permit adjusting the positioning rod.

7. The method of claim 6, wherein the explosive ordnance is an improvised explosive device.

8. The method of claim 6, wherein the explosive ordnance is a pipe bomb comprising a piece of pipe with two ends and wherein each end has an end cap attached to the pipe.

9. The method of claim 8, wherein at least one end cap has at least one lip and wherein the disrupter is positioned so that it fires a projectile against the lip of an end cap.

10. The method of claim 8, wherein the disrupter is positioned so that it fires a projectile against the body of the pipe.

* * * * *